US010818425B2

(12) United States Patent
Xu et al.

(10) Patent No.: US 10,818,425 B2
(45) Date of Patent: Oct. 27, 2020

(54) HIGH-VOLTAGE LEAD STRUCTURE FOR THREE-DIMENSIONAL WOUND CORE OF TRANSFORMER

(71) Applicant: Haihong Electric Co., LTD., Guangdong (CN)

(72) Inventors: Kaixuan Xu, Guangdong (CN); Lizhen Zhai, Guangdong (CN); Qingning Liang, Guangdong (CN); Jingtao Luo, Guangdong (CN); Libo Zhou, Guangdong (CN)

(73) Assignee: Haihong Electric Co., LTD., Guangdong (CN)

( * ) Notice: Subject to any disclaimer, the term of this patent is extended or adjusted under 35 U.S.C. 154(b) by 0 days.

(21) Appl. No.: 16/468,125

(22) PCT Filed: Nov. 24, 2017

(86) PCT No.: PCT/CN2017/112732
§ 371 (c)(1),
(2) Date: Jun. 10, 2019

(87) PCT Pub. No.: WO2018/176868
PCT Pub. Date: Oct. 4, 2018

(65) Prior Publication Data

US 2020/0075227 A1 Mar. 5, 2020

(30) Foreign Application Priority Data

Apr. 1, 2017 (CN) ..... 2017 2 0347266 U

(51) Int. Cl.
*H01F 30/12* (2006.01)
*H01F 27/29* (2006.01)
(Continued)

(52) U.S. Cl.
CPC ..... *H01F 27/29* (2013.01); *H01F 27/266* (2013.01); *H01F 27/2828* (2013.01); *H01F 30/12* (2013.01)

(58) Field of Classification Search
USPC ..... 336/5
See application file for complete search history.

(56) References Cited

U.S. PATENT DOCUMENTS 6,683,524 B1 * 1/2004 Hoglund ..... H01F 27/25 336/212
8,963,677 B2 * 2/2015 Xu ..... H01F 27/06 336/210
(Continued)

FOREIGN PATENT DOCUMENTS

CN 103081042 A 5/2013
CN 203760280 U 8/2014
(Continued)

OTHER PUBLICATIONS

International Search Report and Written Opinion dated Feb. 9, 2018, for corresponding International Application No. PCT/CN2017/112732 International Filing Date: Nov. 24, 2017 consisting of 7-pages.
(Continued)

*Primary Examiner* — Ronald Hinson
(74) *Attorney, Agent, or Firm* — Christopher & Weisberg, P.A.

(57) ABSTRACT

A high-voltage lead structure for a three-dimensional wound core of a transformer that includes a three-dimensional wound core spliced by three rectangular single frames, and A-phase, B-phase and C-phase windings. The three-dimensional wound core includes three core legs, an upper iron yoke and a lower iron yoke. The upper iron yoke and the lower iron yoke of the three-dimensional wound core are triangular structures respectively. The A-phase, B-phase and
(Continued)

C-phase windings are correspondingly arranged in the three core legs. Each single-phase winding includes an internal low-voltage winding and an external high-voltage winding. High-voltage windings of the A-phase, the B-phase and the C-phase are jointly connected to a tap switch through lead-out wires. The tap switch is located outside the triangular structure of the upper iron yoke and is arranged in a vertical extension line of a midpoint between the A-phase and C-phase windings.

9 Claims, 1 Drawing Sheet

(51) Int. Cl.
*H01F 27/26* (2006.01)
*H01F 27/28* (2006.01)

(56) References Cited

U.S. PATENT DOCUMENTS

2010/0194515 A1* 8/2010 Hurst ..... H01F 3/02 336/212
2012/0139678 A1* 6/2012 Outten ..... H01F 30/12 336/5
2012/0146753 A1* 6/2012 Lukso ..... H01F 27/027 336/5
2013/0049912 A1* 2/2013 Cavender ..... H01F 3/02 336/5
2013/0106546 A1* 5/2013 Outten ..... H01F 30/12 336/5
2013/0213777 A1 8/2013 Dohnal et al.
2013/0300526 A1* 11/2013 Bockholt ..... H01F 27/085 336/60
2013/0328652 A1* 12/2013 Outten ..... H01F 38/02 336/5
2014/0320253 A1* 10/2014 Carlen ..... H01F 27/25 336/212
2014/0354386 A1* 12/2014 Adar ..... H01F 27/25 336/5
2015/0109085 A1* 4/2015 Weber ..... H01F 29/025 336/145

FOREIGN PATENT DOCUMENTS

CN 204117789 U 1/2015
CN 205900276 U 1/2017

OTHER PUBLICATIONS

EnglishTranslation of International Search Report dated Feb. 9, 2018, for corresponding International Application No. PCT/CN2017/112732 International Filing Date: Nov. 24, 2017 consisting of 2-pages.
English Translation of Written Opinion dated Feb. 5, 2018, for corresponding International Application No. PCT/CN2017/112732 International Filing Date: Nov. 24, 2017 consisting of 4-pages.

* cited by examiner

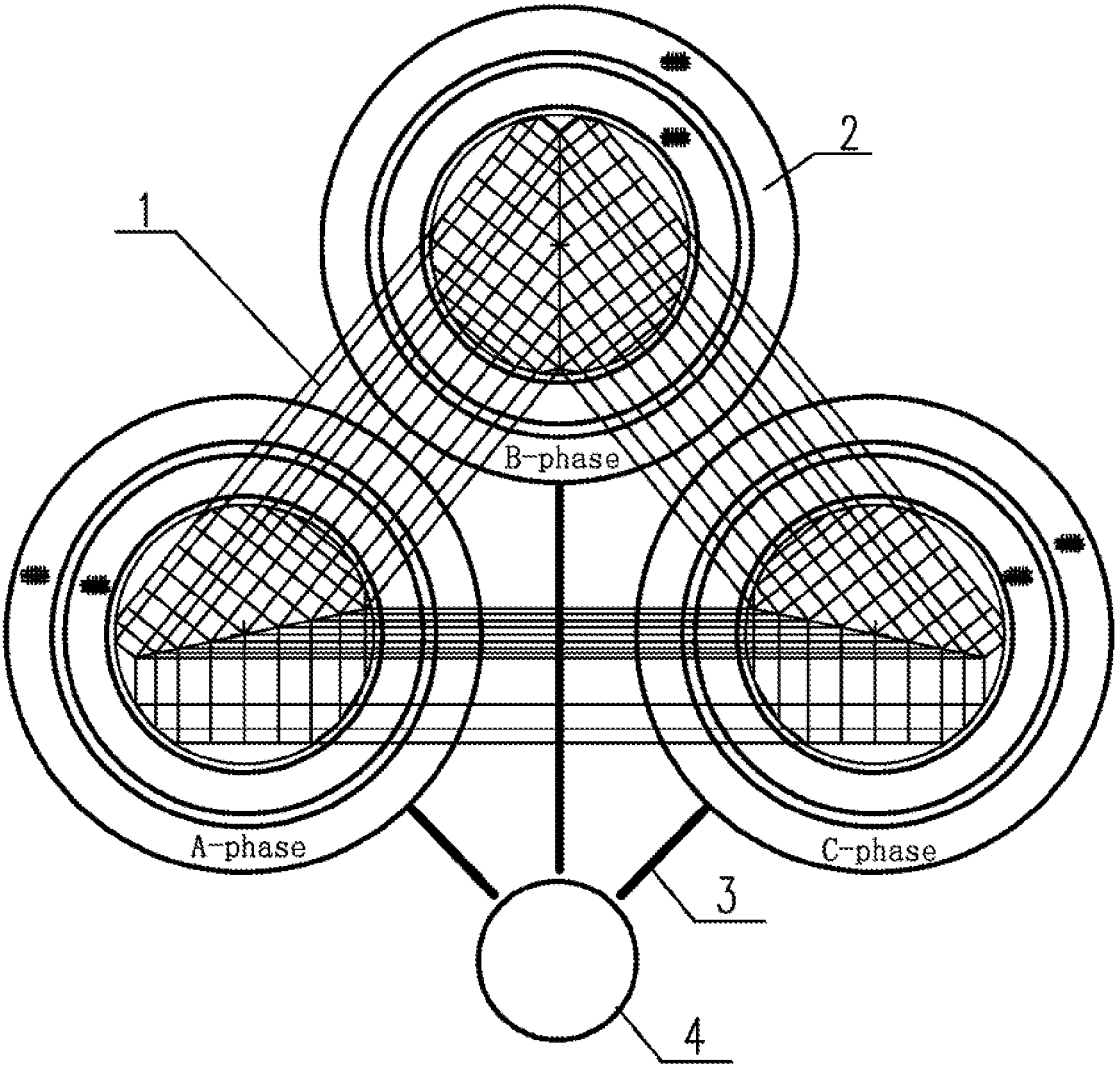
1
2
B-phase
A-phase
C-phase
3
4

HIGH-VOLTAGE LEAD STRUCTURE FOR THREE-DIMENSIONAL WOUND CORE OF TRANSFORMER

CROSS-REFERENCE TO RELATED APPLICATION

This application is a Submission under 35 U.S.C. § 371 for U.S. National Stage Patent Application of International Application Number PCT/CN2017/112732, filed Nov. 24, 2017, entitled NOVEL HIGH-VOLTAGE LEAD STRUCTURE FOR THREE-DIMENSIONAL WOUND CORE OF TRANSFORMER, which claims priority to Chinese Application No. 201720347266.2, filed Apr. 1, 2017, the entirety of both of which are incorporated herein by reference.

FIELD

The disclosure relates to the field of transformer technologies, and more particularly, to a novel high-voltage lead structure for a three-dimensional wound core of a transformer.

BACKGROUND

At present, a transformer product with a three-phase wound core has been favored by more and more customers, and the advantages of high efficiency and energy saving have long been known by people. However, lead-out wires of leads of three-phase high-voltage windings of a traditional transformer with the three-phase wound core are respectively led out in two or three directions from the body of the transformer, and the three-phase leads need to be connected to the same switch. One-phase or two-phase wire must bypass other windings, thus increasing a length of the lead, the insulation fixation and the difficulty.

SUMMARY

The disclosure is intended to provide a novel high-voltage lead structure for a three-dimensional wound core of a transformer, which solves the problem of difficulty in arranging leads of high-voltage windings of a transformer.

In the disclosure, the technical solutions for solving the technical problems are as follows.

A novel high-voltage lead structure for a three-dimensional wound core of a transformer includes a three-dimensional wound core spliced by three rectangular single frames, and A-phase, B-phase and C-phase windings. The three-dimensional wound core includes three core legs, an upper iron yoke and a lower iron yoke. The upper iron yoke and the lower iron yoke of the three-dimensional wound core are triangular structures respectively. The A-phase, B-phase and C-phase windings are correspondingly arranged in the three core legs. Each single-phase winding includes an internal low-voltage winding and an external high-voltage winding. High-voltage windings of the A-phase, the B-phase and the C-phase are jointly connected to a tap switch through lead-out wires. The tap switch is located outside the triangular structure of the upper iron yoke and is arranged in a vertical extension line of a midpoint between the A-phase and C-phase windings.

Further, the lead-out wire of the B-phase high-voltage winding is located in the vertical extension line of the midpoint between the A-phase and C-phase windings.

Further, the lead-out wire of the B-phase high-voltage winding is located in the triangular structure of the upper iron yoke.

Further, the lead-out wires of the A-phase and C-phase high-voltage windings are located outside the triangular structure of the upper iron yoke.

Further, the rectangular single frame is continuously wound by a plurality of sheets or amorphous alloy strips of silicon steel.

The disclosure has the beneficial effects that: according to the disclosure, by adjusting a position of a B-phase lead-out wire of the high-voltage winding and a distance between the A-phase and the C-phase, an output end of the lead-out wire of the B-phase high-voltage winding and a tap are concentrated in a middle of the distance between the A-phase and the C-phase. The lead-out wire of the B-phase high-voltage winding is directly penetrated from the middle of the A-phase and the C-phase and is led to the tap switch. Positions of tapped lead-out wires of the A-phase and the C-phase directly face the tap switch, so that a length of the lead is greatly shortened, the required lead clamping pieces are few, and discharge points of the lead to the ground are greatly reduced, thus improving the reliability of a transformer product.

The details of one or more aspects of the disclosure are set forth in the accompanying drawings and the description below. Other features, objects, and advantages of the techniques described in this disclosure will be apparent from the description and drawings, and from the claims.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein:

FIG. 1 is a structure diagram according to the disclosure.

DETAILED DESCRIPTION

The disclosure is further described below with reference to the drawings and the embodiments.

As shown in FIG. 1, a novel high-voltage lead structure for a three-dimensional wound core of a transformer according to the disclosure includes a three-dimensional wound core 1 spliced by three rectangular single frames, and A-phase, B-phase and C-phase windings, wherein the three-dimensional wound core 1 includes three core legs, an upper iron yoke and a lower iron yoke. The upper iron yoke and the lower iron yoke of the three-dimensional wound core 1 are triangular structures respectively. The A-phase, B-phase and C-phase windings 2 are correspondingly arranged in the three core legs, wherein each single-phase winding 2 includes an internal low-voltage winding and an external high-voltage winding. High-voltage windings of the A-phase, the B-phase and the C-phase are jointly connected to a tap switch 4 through lead-out wires 3. The tap switch 4 is located outside the triangular structure of the upper iron yoke and is arranged in a vertical extension line of a midpoint between the A-phase and C-phase windings.

The lead-out wire 3 of the B-phase high-voltage winding is located in the vertical extension line of the midpoint between the A-phase and C-phase windings.

The lead-out wire 3 of the B-phase high-voltage winding is located in the triangular structure of the upper iron yoke.

The lead-out wires 3 of the A-phase and C-phase high-voltage windings are located outside the triangular structure of the upper iron yoke.

According to the disclosure, by adjusting a position of a B-phase lead-out wire of the high-voltage winding and a distance between the A-phase and the C-phase, an output end of the lead-out wire 3 of the B-phase high-voltage winding and a tap are concentrated in a middle of the distance between the A-phase and the C-phase. The lead-out wire 3 of the B-phase high-voltage winding is directly penetrated from the middle of the A-phase and the C-phase, and is led to the tap switch. Positions of tapped lead-out wires 3 of the A-phase and the C-phase directly face the tap switch 4, so that a length of the lead is greatly shortened, the required lead clamping pieces are few, and discharge points of the lead to the ground are greatly reduced, thus improving the reliability of a transformer product.

The rectangular single frame is continuously wound by a plurality of sheets or amorphous alloy strips of silicon steel.

It should appreciate that, the description above does not limit the disclosure, and the disclosure is not limited to the embodiments above. Any variation, modifications, additions or substitutions made by those skilled in the art within a substantial scope of the disclosure shall also fall within the protection scope for the disclosure.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A high-voltage lead structure for a three-dimensional wound core of a transformer, comprising A-phase, B-phase and C-phase windings; and a three-dimensional wound core spliced by three rectangular single frames and comprising three core legs, an upper iron yoke and a lower iron yoke;

the upper iron yoke and the lower iron yoke of the three-dimensional wound core are triangular structures respectively;

the A-phase, B-phase and C-phase windings are correspondingly arranged in the three core legs;

each single-phase winding has an internal low-voltage winding and an external high-voltage winding;

high-voltage windings of the A-phase, the B-phase and the C-phase are jointly connected to a tap switch through lead-out wires; and the tap switch is located outside the triangular structure of the upper iron yoke and is arranged in a vertical extension line of a midpoint between the A-phase and C-phase windings.

2. The high-voltage lead structure for a three-dimensional wound core of a transformer according to claim 1, wherein the lead-out wires (3) of the A-phase and C-phase high-voltage windings are located outside the triangular structure of the upper iron yoke.

3. The high-voltage lead structure for a three-dimensional wound core of a transformer according to claim 1, wherein the rectangular single frame is continuously wound by a plurality of sheets or amorphous alloy strips of silicon steel.

4. The high-voltage lead structure for a three-dimensional wound core of a transformer according to claim 1, wherein the lead-out wire of the B-phase high-voltage winding is located in the vertical extension line of the midpoint between the A-phase and C-phase windings.

5. The high-voltage lead structure for a three-dimensional wound core of a transformer according to claim 4, wherein the lead-out wires of the A-phase and C-phase high-voltage windings are located outside the triangular structure of the upper iron yoke.

6. The high-voltage lead structure for a three-dimensional wound core of a transformer according to claim 4, wherein the rectangular single frame is continuously wound by a plurality of sheets or amorphous alloy strips of silicon steel.

7. The high-voltage lead structure for a three-dimensional wound core of a transformer according to claim 4, wherein the lead-out wire of the B-phase high-voltage winding is located in the triangular structure of the upper iron yoke.

8. The high-voltage lead structure for a three-dimensional wound core of a transformer according to claim 7, wherein the lead-out wires of the A-phase and C-phase high-voltage windings are located outside the triangular structure of the upper iron yoke.

9. The high-voltage lead structure for a three-dimensional wound core of a transformer according to claim 7, wherein the rectangular single frame is continuously wound by a plurality of sheets or amorphous alloy strips of silicon steel.

* * * * *